US006825762B2

(12) United States Patent
Giacopelli et al.

(10) Patent No.: US 6,825,762 B2
(45) Date of Patent: Nov. 30, 2004

(54) DEVICE FOR DIRECTING A PREMISES ALARM PANEL TO A BACKUP RADIO NETWORK UPON DETECTION OF USE OF THE PSTN BY ANOTHER PREMISES DEVICE

(75) Inventors: Daniel Giacopelli, Deer Park, NY (US); Jeffrey M. Hickey, Patchogue, NY (US); Joseph Campanelli, Hauppauge, NY (US)

(73) Assignee: Telular Corp., Vernon Hills, IL (US)

( * ) Notice: Subject to any disclaimer, the term of this patent is extended or adjusted under 35 U.S.C. 154(b) by 132 days.

(21) Appl. No.: 10/303,693

(22) Filed: Nov. 25, 2002

(65) Prior Publication Data

US 2003/0142794 A1 Jul. 31, 2003

Related U.S. Application Data

(60) Provisional application No. 60/347,805, filed on Jan. 10, 2002.

(51) Int. Cl.[7] ..... G08B 1/00

(52) U.S. Cl. ..... 340/531; 340/506; 340/507; 379/37; 379/39; 379/42; 379/46; 379/106.08; 455/404.1

(58) Field of Search ..... 340/531, 506, 340/507, 508, 539.1, 3.43, 3.44; 379/37–51; 455/404.1

(56) References Cited

U.S. PATENT DOCUMENTS

| | | | | | |
|---|---|---|---|---|---|
| 4,012,728 | A | | 3/1977 | Fowler | 340/224 |
| 4,964,065 | A | | 10/1990 | Hicks et al. | 364/514 |
| 4,993,059 | A | | 2/1991 | Smith et al. | 379/39 |
| 5,134,644 | A | | 7/1992 | Garton et al. | 379/39 |
| 5,185,779 | A | * | 2/1993 | Dop et al. | 379/33 |
| 5,233,640 | A | * | 8/1993 | Kostusiak | 379/39 |
| 5,327,478 | A | * | 7/1994 | Lebowitz | 379/40 |
| 5,587,701 | A | | 12/1996 | Hess | 340/541 |
| 5,726,636 | A | | 3/1998 | Hayes, Jr. | 340/636 |
| 5,729,197 | A | | 3/1998 | Cash | 340/539 |
| 5,777,551 | A | | 7/1998 | Hess | 340/541 |
| 5,850,180 | A | | 12/1998 | Hess | 340/541 |
| 5,978,470 | A | * | 11/1999 | Shaffer et al. | 379/377 |
| 6,049,273 | A | * | 4/2000 | Hess | 340/539.11 |
| 6,081,546 | A | * | 6/2000 | Williamson et al. | 379/33 |
| 6,614,884 | B2 | * | 9/2003 | Jang | 379/41 |

OTHER PUBLICATIONS

U.S. Published patent application No. US2001/0001234 A1; Mar. 17, 2001; Addy, et al.

"Alarm Doctor" alarm system 7845C –Control Channel Cellular Subscriber Transceiver alarm backup.

"Ambush Alarm Electronics, Inc. 7835C Alarm Net–C" cellular alarm system.

* cited by examiner

*Primary Examiner*—Daryl Pope
(74) *Attorney, Agent, or Firm*—Much, Shelist, Freed

(57) ABSTRACT

A device for redirecting alarm-messaging from an alarm control panel from its connection to the PSTN to a backup radio transceiver for transmission of the alarm signaling to a central alarm station via a radio network. The switch-over to the radio network occurs not only when the PSTN line is down, for whatever reason, but also occurs when the PSTN line is already occupied by an existing transmission by a premises' telephones, in order to allow the user to make a call over the PSTN during such an alarm condition. Moreover, if during the time the alarm control panel is transmitting its alarm messages over the PSTN, a premises' telephone goes off-hook, the device of the invention terminates the alarm panel's connection to the PSTN and automatically switches over the alarm panel to the radio backup system.

20 Claims, 2 Drawing Sheets

DEVICE FOR DIRECTING A PREMISES ALARM PANEL TO A BACKUP RADIO NETWORK UPON DETECTION OF USE OF THE PSTN BY ANOTHER PREMISES DEVICE

CROSS REFERENCE TO RELATED APPLICATION

Priority of provisional application No. 60/347,805, filed on Jan. 10, 2002, is claimed.

BACKGROUND OF THE INVENTION

The present invention is directed to an alarm system that protects a premises, and which communicates with a central, remote reporting station, through the local telephone line of the PSTN connected to the premises-wiring of the protected premise. Typical, conventional alarm systems are installed in such a manner as to allow the alarm control-panel the capability of seizure of the PSTN line for transmitting the alarm-condition alarm signals to its central office, or central station, without hindrance. This has been achieved by routing the incoming PSTN line through the alarm control (C/C) panel itself. The current implementation requires the installer to locate the incoming line. The installer then must modify the line to run through the alarm C/C panel before feeding into the house telephone-wiring using an RJ-31X interconnect. When the alarm C/C panel must communicate an alarm-condition message to the central office, it seizes the PSTN line, which also causes the house telephone line to be disconnected from the PSTN line,—and, therefore, any telephone device connected thereto. The alarm control pane then dials into its message center at the central station, and downloads its alarm-message information. During this time, the house or premises telephones are not operational.

There are also known alarm systems that monitor a premises for an alarm-condition and report such alarm-condition to a central station using either the PSTN as the primary link and a radio link as the secondary backup. Examples of these are shown in U.S. Pat. No. 4,718,079—Rabito, U.S. Pat. No. 5,131,019—Sheffer, et al., and U.S. Pat. No. 4,887,290—Dop, et al There are also prior-art systems that use the radio link as the primary link, and the PSTN line as the secondary, or backup, link. Examples of these prior-art system are shown in U.S. Pat. No. 5,146,486—Lebowitz, and U.S. Pat. No. 5,454,024—Lebowitz. In either type of system, a fault detector or monitor detects the outage or fault of the primary link and automatically switches over the connection of the alarm-panel to the secondary link. In the first type of system, a line-fault detector detects outage of the PSTN line-connection, while in the second type of system, the fault detector is a RF-fault detector.

The present invention is directed to the allowing of the house or premises telephones to have access to the PSTN network during the time an alarm C/C panel is attempting, or in the process of, communicating its alarm-messaging to the central office, and not only switches over to a backup radio link upon the detection of the outage of the PSTN line, but also switches over to the radio backup link when a telephone device connected to the premises wiring is, or is about to, make a call. The present invention also reduces cost, complexity, and time of the installation process of an alarm system which communicates a message to a central station, or other remote location

SUMMARY OF THE INVENTION

It is, therefore, the primary objective of the present invention to provide an alarm-monitoring and reporting system for a house or other premises that automatically switches over its reporting functions to a cellular-based, cellular-like, or the radio, telephone network if the PSTN line is being utilized by a house or premises telephone device, such as a POTS telephone, fax, modem, or other telephone-like device.

It is, also, the primary objective of the present invention to provide such an alarm-monitoring and reporting system for a house or other premises that automatically switches over its reporting functions to a cellular-based, cellular-like, or the radio, telephone network if the PSTN line is being utilized by a house or premises telephone device, that requires a simple installation alarm system which will also allow the system to transmit alarms over the PSTN telephone network when such is not in use by a telephone device.

Accordingly, the alarm system of the invention includes a alarm-panel interface device that monitors the line-condition of the premises-wiring of the protected premises in order to determine if the line is in use. If the premises-wiring line is not in use, the system allows the alarm panel to call into the central office over the PSTN network. If the line is being utilized, the device will redirect the call over a backup radio link, such as the cellular, or cellular-like network. The system also monitors the success of its communication to the central station. If the communication of the messaging to the central station fails for some reason, as, for example, it has been interfered with by another device on the line, then the alarm C/C panel will hang up and attempt a retransmission of the message. The system detects this failure, or, alternatively, a specified number of failed attempts, and disconnects the alarm panel from the PSTN telephone line. Subsequent re-transmissions of the communication are then directed through a backup radio link, such as the switched cellular network.

BRIEF DESCRIPTION OF THE DRAWING

The invention will be more readily understood with reference to the accompanying drawing, wherein.

DETAILED DESCRIPTION OF THE INVENTION

Figure 1:
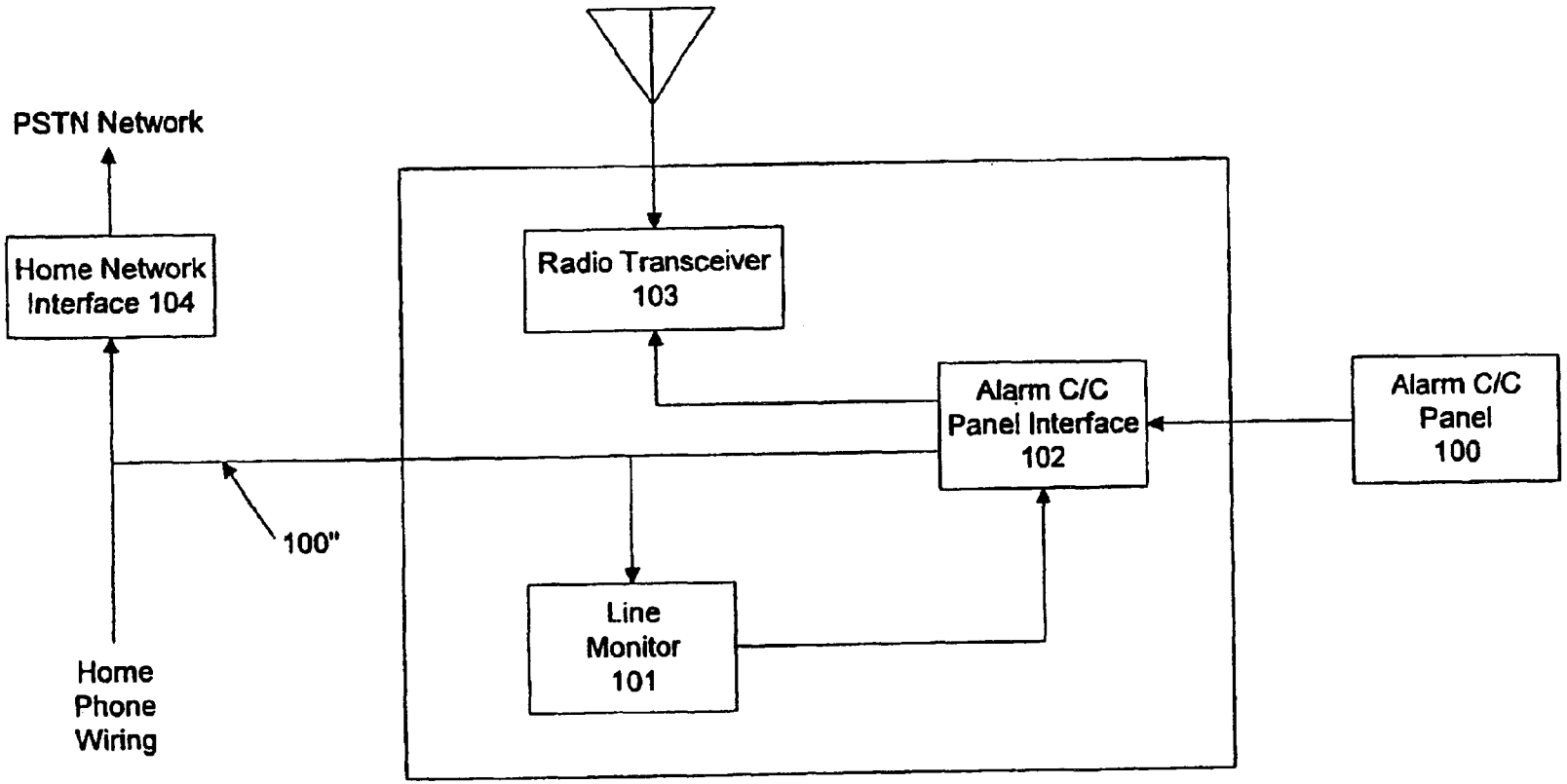
FIG. 1 is a block diagram showing an alarm system incorporating the alarm-panel interface device of the present invention.

Referring to FIG. 1, there is depicted an alarm system consisting of a conventional alarm control (C/C) panel 100 for monitoring a premises for alarm-conditions, and reporting any such alarm-condition to a central station by means of the premises-wiring 100' connected to the PSTN. The alarm control panel 100 for monitoring a premises and reporting an alarm-condition over a telephone line connected to the PSTN is conventional and well-known in the art. The protected premises may be a home, business, and the like, and has its premises-wiring connected to the PSTN network at the home network interface 104, which is typically a RJ-31 interface. The premises-wiring monitoring and control system of the present invention is indicated generally by reference numeral 102, and is connected to the premises-wiring at any convenient location. The alarm C/C panel 100 has a conventional communication output that is connected to the interface 102 of the present invention. The premises-wiring monitoring and control system 102 of the present invention is operatively interposed between the alarm control panel 100 and the premises-wiring 100', and has a dedicated microprocessor and associated software, and a line-monitor device 101 which monitors the status of the premises-line 100' and the off-hook status of the alarm control panel, in order to gauge if the premises-line is free and not in use, and is available for the alarm C/C panel to initiate alarm-condition communication to a central station upon the detection of an alarm-condition at the protected premises. Under these circumstances, the alarm control panel 100 will transmit its alarm-messaging over the PSTN line. The premises-wiring monitoring and control system 102 allows this communication to pass directly onto the premises-wiring and out to the PSTN, since it has detected that the premises-wiring is idle. However, if the interface 102 has detected that the premises-line is not available, but rather that a telephone device is using the PSTN at that time to make a call, or if the line monitor detects a premises telephone device going off-hook in order to make a call over the PSTN during the alarm-condition transmission of the alarm panel, then the alarm panel interface 102 detects this off-hook condition via the line monitor 101 and redirects the alarm panel C/C communication to a backup radio transceiver 103, such as a cellular, or cellular-like, transceiver. The use of the backup radio link for transmitting the alarm-messaging is also utilized in the conventional manner, as described above, for redirecting the transmission of the alarm-messaging to the radio backup link if the line monitor 101 detects outage of the premises-line connected to the PSTN. This outage may be detected during an alarm-condition communication of the alarm panel. Furthermore, if the alarm panel is not successful in completing its communication over the house telephone wiring for whatever reason, the alarm panel interface 102 redirects the communication to the cellular or other radio network through the radio transceiver 103, in a manner that is, also, well-known in the art.

The alarm-panel interface 102 has line-monitor device 101 consisting of a conventional voltage detector monitoring the premises-wiring, and a conventional loop-current sensor for detecting loop-current on the line coupling the alarm-panel interface 102 to the alarm C/C panel 100. The loop-current sensor senses or determines the off-hook status of the alarm C/C panel, which is indicative of the fact that the alarm C/C panel is about, or attempting, to communicate to some outside location, or the central reporting station. The voltage detector monitors the line voltage on the premises-wiring 100'. This line voltage senses or detects an off-hook status indicative of the fact that one or more telephone devices connected to the premises wiring are about to, or are accessing, the PSTN line. It also senses or determines if the connection to the PSTN network is valid, and if there is an outage thereof.

In the steady-state condition, where the alarm panel 100 is not sending an alarm-message over the PSTN line, the loop-current sensor of the alarm-panel interface 102 is in a status where it is ready to sense any current flow of the alarm C/C panel when it goes off-hook to transmit an alarm-condition. As long as the voltage detector of the alarm-panel interface 102 senses a preset and predetermined voltage across the premises wiring, which is indicative that the premises-wiring it is not in use, the alarm C/C panel remains connected to the premises wiring for transmission over the PSTN should an alarm-condition present itself. If the voltage detector of the alarm-panel interface 102 detects that the voltage across the premises wiring line drops below a preset and predetermined threshold, such would indicate that a telephone device associated with the premises wiring has gone off-hook, and that the premises-wiring is in use, or about to be used by the telephone device. In this state, the alarm panel 100 is switched over to the radio transceiver backup system by conventional switching.

In the alarm-present state, when the alarm C/C panel 100 is in the process of communication over the premises wiring to PSTN line, the current sensor detects the off-hook state thereof. Based upon known characteristics of a conventional alarm C/C panel, the voltage detector of the alarm-panel interface 102 continuously determines if a second device connected to the premises wiring has gone off-hook that also seeks access to the PSTN line. Upon such a detection, the microprocessor of the alarm-panel interface 102 will cause actuation of a control switch for switching over connection of the alarm panel to the radio backup link 103. This would give access of the PSTN network to the other telephone device on the premises line, whereby the user may make an outgoing call, as, for example, to the police. During this switch over to the radio backup link, the alarm C/C panel 100 in the conventional manner recognizes the fact that it did not successfully complete its communication, and will retry to transmit its communication over the radio backup link via transceiver 103.

Figure 2:
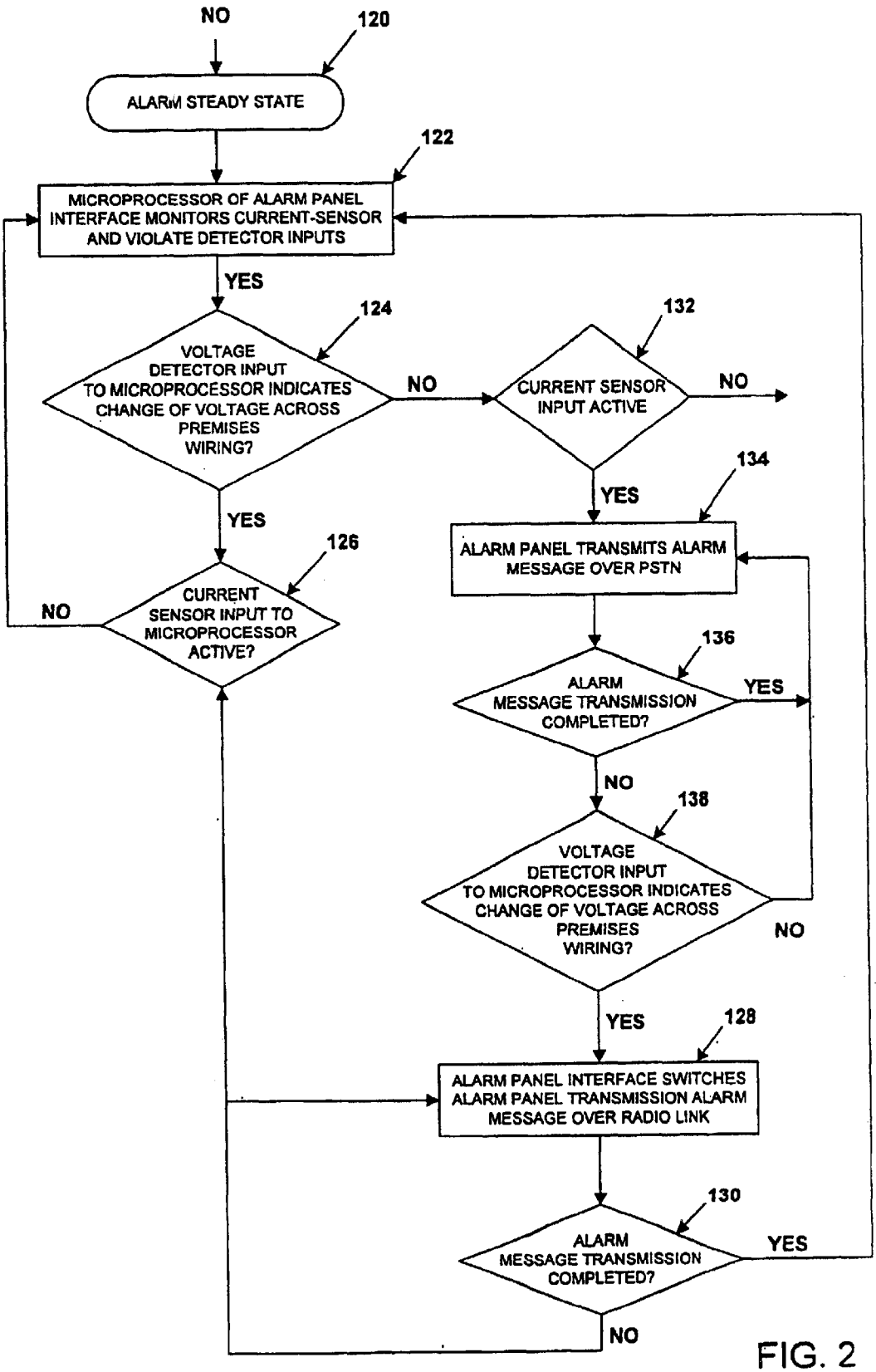
FIG. 2 is a flow chart showing the software process steps thereof.

Referring to FIG. 2, there is shown a flow chart of the system of the invention. In the alarm steady-state (block 120), the microprocessor of the alarm-panel interface of the invention continually monitors the current-sensor and voltage-detector inputs thereof (block 122) for a change of state. The software of the alarm-panel interface of the invention checks to see if there is a change in the voltage-detector input (decision block 124). If the answer is "YES", indicating an off-hook has occurred on one of the telephone devices connected to the protected premises wiring, the software then checks to see if there is also a change in the current-sensor input (decision block 126). If "NO", then the program returns to the steady state where there is no alarm-condition present, where the alarm panel is quiescent. If the software does determine that the current-sensor input is active ("YES" to decision block 261), meaning that the alarm panel has been activated due to the sensing of an alarm-condition at the protected premises at the same time that one of the telephone device connected to the premises-wiring is off-hook and using the PSTN line, then the software causes the alarm-panel interface of the invention to switch operative connection of the alarm panel from the PSTN line to the radio backup link (block 128), whereupon the alarm panel sends out its alarm-message via a radio network. The software of the invention checks to see if the alarm panel has completed its transmission over the radio backup link (decision block 130), and if it has not ("NO" to decision block 130), then it is allowed to continue to transmit. If it has completed its transmission ("YES" to decision block 130), then the program returns to its steady state mode waiting for a change in status of the alarm panel. It is noted that after the alarm panel has completed its transmission over the radio backup link, the alarm-panel interface will return the connection of the alarm panel back to the PSTN line after the telephone device or devices are on-hook again (block 122).

If the answer to decision block 124 is "NO", indicating that no telephone device connected to the premises wiring is off-hook, then the program of the alarm-panel interface of the invention determines if the microprocessor detects a current-sensor input of the alarm-panel to see if it has gone off-hook in order to send out an alarm-message (decision block 132). If "NO", then the program returns to its steady-state. If "YES", then the alarm panel is allowed to transmit its alarm-message over the PSTN line at the protected premises (block 134). The software of the invention monitors this transmission, and determines if it has been completed (decision block 136). If "YES", the program returns to its steady state. If "NO", then the software continually monitors the status of the telephone devices of the premises-wiring to determine if any has gone off-hook (decision block 138). If "NO", then the alarm panel is allowed to continue to transmit over the PSTN line (block 134). If "YES", meaning that a telephone device has gone off-hook, then the software of the invention causes the alarm-panel interface to switch over to the radio backup link (blocks 128, 130), and proceeds in the manner described above in regards to the state where, upon initial actuation of the alarm panel, the premises-wiring was already seized by a telephone device.

It is to be understood that the alarm-panel interface 102 of the invention may immediately switch over connection of the alarm panel 100 even before the alarm panel has detected an alarm-condition and has gone off-hook to transmit an alarm-message, as soon as an off-hook condition of a telephone device connected to the premises-wiring has been detected, and will switch back to the PSTN line as soon as telephone device has been detected as being on-hook.

It is, also, noted that the backup link may be another landline link instead of a radio link. For example, the backup link may be the second premises-line at the protected premises if such premises has a second line connected to the PSTN.

While a specific embodiment of the invention has been shown and described, it is to be understood that numerous changes and modifications may be made therein without departing from the scope and spirit of the invention as set forth in the appended claims.

What is claimed is:

1. In an alarm monitoring and reporting system for monitoring a premises and reporting an alarm-condition at the premises to a remote site via at least one of a PSTN line and a backup link, the improvement comprising:

an alarm-system interface means operatively coupled to said alarm monitoring and reporting system;

said alarm-system interface means comprising first detecting means for detecting off-hook status of said alarm monitoring and reporting system, and second detecting means for detecting off-hook status of a premises telephone-device connected to the premises-wiring;

and means for switching connection of said alarm monitoring and reporting system to a backup link when said second means detects the off-hook status of a premises telephone-device.

2. The improvement according to claim 1, wherein said alarm-system interface means comprises a microprocessor, memory means, and software means stored in said memory means; said software means comprising means for initiating the switching over of said alarm monitoring and reporting system to the backup link after said alarm monitoring and reporting system has initiated transmission over the PSTN link at the premises in response to said second means having detected an off-hook status of a premises telephone-device.

3. The improvement according to claim 1, wherein said alarm-system interface means comprises a microprocessor, memory means, and software means stored in said memory means; said software means comprising means for initiating the switching over of said alarm monitoring and reporting system to the backup link before said alarm monitoring and reporting system has initiated transmission over the PSTN link at the premises in response to said second means having detected an off-hook status of a premises telephone-device.

4. The improvement according to claim 1, in combination with premises-wiring of a protected premises; said alarm-system interface means being operatively connected to said premises-wiring; said alarm-system interface means interfacingly connecting said alarm monitoring and reporting system to said premises wiring; said alarm-system interface means comprising first connecting means connected to said alarm monitoring and reporting system, and second connecting means connected to said premises wiring; said first connecting means comprising said first detecting means, and said second connecting means comprising said second detecting means.

5. The improvement according to claim 4, wherein said alarm-system interface means comprises a microprocessor, memory means, and software means stored in said memory means; said software means comprising means for initiating the switching over of said alarm monitoring and reporting system to the backup link after said alarm monitoring and reporting system has initiated transmission over the PSTN link at the premises in response to said second means having detected an off-hook status of a premises telephone-device.

6. The improvement according to claim 4, wherein said alarm-system interface means comprises a microprocessor, memory means, and software means stored in said memory means; said software means comprising means for initiating the switching over of said alarm monitoring and reporting system to the backup link before said alarm monitoring and reporting system has initiated transmission over the PSTN link at the premises in response to said second means having detected an off-hook status of a premises telephone-device.

7. The improvement according to claim 5, wherein said software means further comprises other means for initiating the switching over of said alarm monitoring and reporting system to the backup link before said alarm monitoring and reporting system has initiated transmission over the PSTN link at the premises in response to said second means having detected an off-hook status of a premises telephone-device.

8. An alarm-system interface device for a premises alarm monitoring and reporting system monitoring a premises for an alarm-condition and reporting an alarm-condition at the premises to a remote site via a PSTN line or a backup link, comprising:

alarm-interface means;

said alarm-interface means comprising first detecting means for detecting the off-hook status of the alarm monitoring and reporting system, and second detecting means for detecting the off-hook status of a premises telephone-device connected to the premises-wiring; and means for switching connection of the alarm monitoring and reporting system to a backup link when said second means detects the off-hook status of a premises telephone-device.

9. The alarm-system interface device for a premises alarm monitoring and reporting system according to claim 8, wherein said alarm-interface means further comprises a microprocessor, memory means, and software means stored in said memory means;

said software means comprising means for initiating the switching over of the alarm monitoring and reporting system to the backup link after the alarm monitoring and reporting system has initiated transmission over the PSTN link at the premises in response to said second means having detected an off-hook status of a premises telephone-device.

10. The alarm-system interface device for a premises alarm monitoring and reporting system according to claim 8, wherein said alarm-interface means comprises a microprocessor, memory means, and software means stored in said memory means;

said software means comprising means for initiating the switching over of the alarm monitoring and reporting system to the backup link before the alarm monitoring and reporting system has initiated transmission over the PSTN link at the premises in response to said second means having detected an off-hook status of a premises telephone-device.

11. The alarm-system interface device for a premises alarm monitoring and reporting system according to claim 8, in combination with premises-wiring of a protected premises; said alarm-interface means being operatively connected to said premises-wiring; said alarm-interface means interfacing the alarm monitoring and reporting system to said premises wiring; said alarm-interface means comprising first connecting means connected to the alarm monitoring and reporting system, and second connecting means connected to said premises wiring; said first connecting means comprising said first detecting means, and said second connecting means comprising said second detecting means.

12. The alarm-system interface device for a premises alarm monitoring and reporting system according to claim 11, wherein said alarm-interface means comprises a microprocessor, memory means, and software means stored in said memory means;

said software means comprising means for initiating the switching over of said alarm monitoring and reporting system to the backup link before the alarm monitoring and reporting system has initiated transmission over the PSTN link at the premises in response to said second means having detected an off-hook status of a premises telephone-device.

13. The alarm-system interface device for a premises alarm monitoring and reporting system according to claim 12, wherein said software means further comprises other means for initiating the switching over of the alarm monitoring and reporting system to the backup link before the alarm monitoring and reporting system has initiated transmission over the PSTN link at the premises in response to said second means having detected an off-hook status of a premises telephone-device.

14. The alarm-system interface for a premises alarm monitoring and reporting system according to claim 13, further in combination with a radio backup link for transmitting alarm-messages over a radio network when said other means for initiating the switching over of the alarm monitoring and reporting system switched over said premises alarm monitoring and reporting system.

15. A method of switching over connection of an alarm monitoring and reporting system protecting a premises from the PSTN line at the protected premises to a backup link, comprising:

(a) monitoring the premises-wiring at the protected premises for off-hook status of a telephone device connected thereto;

(b) switching over connection of the alarm monitoring and reporting system from the PSTN line to a backup link upon detection of off-hook status in said step (a).

16. The method of switching over connection of an alarm monitoring and reporting system protecting a premises from the PSTN line at the protected premises to a backup link, according to claim 15, further comprising before said step (a):

(c) transmitting alarm-data messaging of the alarm monitoring and reporting system over the PSTN line; and (d) said step (b) comprises detecting the off-hook status after said step (c);

(e) said step (b) comprising switching over connection to the backup link before the alarm-data messaging of the alarm monitoring and reporting system over the PSTN line has been completed;

(f) re-transmitting the alarm-data messaging of the alarm monitoring and reporting system over the backup link.

17. The method of switching over connection of an alarm monitoring and reporting system protecting a premises from the PSTN line at the protected premises to a backup link, according to claim 15, further comprising:

(c) detecting off-hook status of the alarm monitoring and reporting system indicative of the alarm monitoring and reporting system's actuation by an alarm-condition requiring transmission to a monitoring station;

(d) said step (b) comprising detecting the off-hook status of a premises telephone device before said step (c);

(e) said step (b) comprising switching over connection to the backup link after said step (c); and (f) transmitting the alarm-data messaging of the alarm monitoring and reporting system over the backup link.

18. The method of switching over connection of an alarm monitoring and reporting system protecting a premises from the PSTN line at the protected premises to a backup link, according to claim 16, further comprising after said step (e):

(f) making an outgoing call from a telephone-device connected to the premises-wiring over the PSTN line.

19. The method of switching over connection of an alarm monitoring and reporting system protecting a premises from the PSTN line at the protected premises to a backup link, according to claim 17, further comprising before said step (c):

(g) making an outgoing call from a telephone-device connected to the premises-wiring over the PSTN line.

20. The method of switching over connection of an alarm monitoring and reporting system protecting a premises from the PSTN line at the protected premises to a backup link, according to claim 15, further comprising:

before said step (a):

(c) transmitting alarm-data messaging of the alarm monitoring and reporting system over the PSTN line;

(d) said step (b) comprises detecting the off-hook status after said step (c);

(e) said step (b) comprising switching over connection to the backup link before the alarm-data messaging of the alarm monitoring and reporting system over the PSTN line has been completed;

(f) re-transmitting and completing the transmission of the alarm-data messaging of the alarm monitoring and reporting system over the backup link;

(g) after said step (f), repeating said steps (a) and (b); and (h) detecting off-hook status of the alarm monitoring and reporting system indicative of the alarm monitoring and reporting system's actuation by an alarm-condition requiring transmission to a monitoring station;

(i) said repeated step (b) comprising detecting the off-hook status of a premises device before said step (h);

(j) said repeated step (b) comprising switching over connection to the backup link after said step (h); and (k) transmitting the alarm-data messaging of the alarm monitoring and reporting system over the backup link.

* * * * *